US007089931B2

(12) United States Patent
Bee

(10) Patent No.: US 7,089,931 B2
(45) Date of Patent: Aug. 15, 2006

(54) RESPIRATORS

(75) Inventor: Christopher Rodney Bee, Salisbury (GB)

(73) Assignee: Secretary of State for Defence, Salisbury (GB)

( * ) Notice: Subject to any disclaimer, the term of this patent is extended or adjusted under 35 U.S.C. 154(b) by 0 days.

(21) Appl. No.: 10/504,370

(22) PCT Filed: Feb. 13, 2003

(86) PCT No.: PCT/GB03/00689

§ 371 (c)(1),
(2), (4) Date: Aug. 12, 2004

(87) PCT Pub. No.: WO03/068318

PCT Pub. Date: Aug. 21, 2003

(65) Prior Publication Data

US 2005/0217669 A1 Oct. 6, 2005

(30) Foreign Application Priority Data

Feb. 16, 2002 (GB) ..... 0203701.8

(51) Int. Cl.
*A62B 18/00* (2006.01)

(52) U.S. Cl. ..... 128/201.28; 128/202.11; 128/202.19

(58) Field of Classification Search ..... 128/201.28, 128/203.11, 205.24, 207.16, 201.23, 201.24, 128/201.15, 200.28, 201.22, 205.25, 206.12, 128/206.15, 206.21, 206.28, 201.25, 201.29, 128/202.19, 202.11, 207.11, 207.12, 207.17
See application file for complete search history.

(56) References Cited

U.S. PATENT DOCUMENTS

| | | | | |
|---|---|---|---|---|
| 2,810,386 | A * | 10/1957 | Reed | 128/201.15 |
| 3,716,053 | A * | 2/1973 | Almovist et al. | 128/201.15 |
| 4,126,131 | A | 11/1978 | Davis et al. | |
| 4,276,877 | A * | 7/1981 | Gdulla | 128/200.27 |
| 4,352,353 | A | 10/1982 | Bolton et al. | |
| 4,676,236 | A | 6/1987 | Piorkowski et al. | |
| 5,245,993 | A | 9/1993 | McGrady et al. | |
| 5,704,073 | A | 1/1998 | Sword et al. | |
| 6,085,748 | A * | 7/2000 | Sword et al. | 128/206.23 |
| 6,520,177 | B1 * | 2/2003 | Bonhomme et al. | 128/201.28 |

FOREIGN PATENT DOCUMENTS

| | | |
|---|---|---|
| EP | 0363530 | 4/1990 |
| GB | 2046101 | 11/1980 |
| GB | 2074457 | 11/1981 |
| GB | 2211098 | 6/1989 |
| GB | 2233905 A * | 1/1991 |
| WO | WO 96/07452 | 3/1996 |

* cited by examiner

*Primary Examiner*—Henry Bennett
*Assistant Examiner*—Shumaya B. Ali
(74) *Attorney, Agent, or Firm*—Dean W. Russell; Kilpatrick Stockton LLP

(57) ABSTRACT

A respirator (1) having a plurality of internal masks (2, 3) within an external mask (4), the inner masks (2, 3) being linked by ducts (8, 9) so as to direct the inhaled air from the outside of the mask to the oronasal area via an ocular mask. The oronasal mask (3) has a secondary valve (12) that is sprung so as to operate within the timeframe of the exhalation part of the breathing cycle, the exhaled air being ejected into the hollow outer body of the mask (4).

7 Claims, 1 Drawing Sheet

RESPIRATORS

Cross Reference to Related Applications

Figure 1:
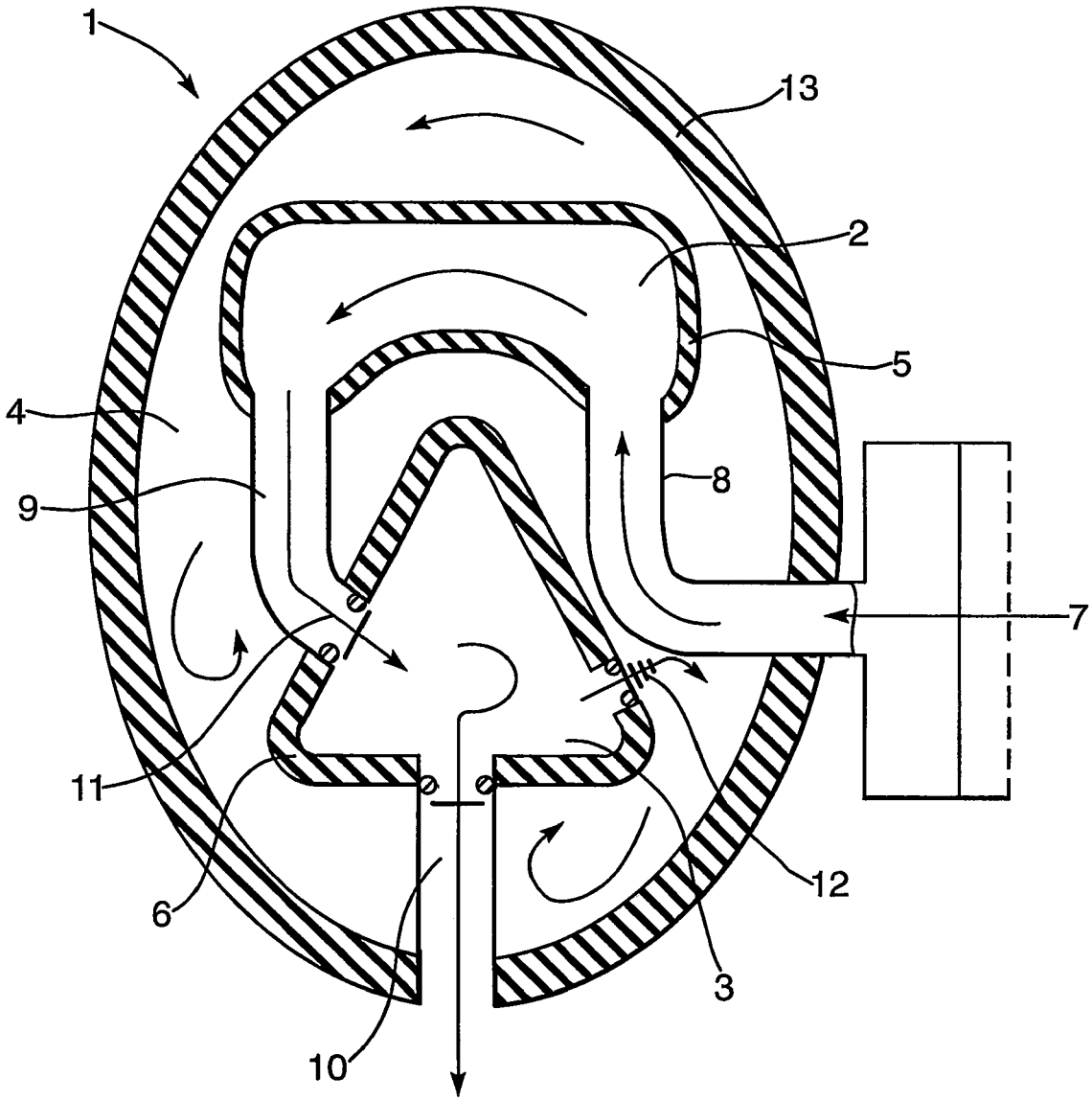

This application is the U.S. national phase of International Application No. PCT/GB03/00689 filed on Feb. 13, 2003 and published in English as International Publication No. WO 03/0683 18 Al on Aug. 21, 2003, which application claims priority to Great Britain Application No. 0203701.8 filed on Feb. 16, 2002, the contents of which are incorporated by reference herein.

This invention relates to respirators and provides a respirator with distinct inner masks, in order to give the wearer extra protection, which are designed to use the inhaled and exhaled air to enhance the effectiveness of the respirator.

Respirators which enable workers to operate in hazardous environments having airborne contaminants, commonly rely on the exhaled air of the wearer to produce a positive pressure inside the mask. Thus if there is any leakage into the mask where it forms a seal with the wearer's head, or if the mask's containment is breached, the exhaled air will flow out from the mask, purging the mask and transporting any contaminated ambient air away.

However, the pressure inside conventional respirators falls below ambient on inhalation, so that inward leakage may occur, enabling contaminants to enter the inside of the mask. Any contaminants inside the mask can cause harm or discomfort to the wearer, particularly if they are free to attack the eyes or oronasal cavities.

Masks have been designed to overcome the problem of in—leakage, usually by incorporating mechanical pumps and such like to maintain a positive pressure inside the respirator. Such devices are not fail-safe however, and add weight to the mask. Where the exhaled air is conventionally used to increase the pressure inside the mask, it requires breathing effort to maintain the higher interior pressure which is uncomfortable and tiring for the wearer.

A second known problem of respirators that incorporate an eyepiece is that the eyepiece is often prone to misting. This can be partially overcome by causing the inhaled air to flow over the eyepiece and directing the exhaled air away from the eyepiece. However, in such respirators there is a disadvantage in that any contaminated air that leaks into the mask will be caused to flow over the eyepieces, attacking the eyes.

It would be advantageous, therefore, to develop a respirator in which both the inhaled and exhaled air contribute to the functionality of the mask without resorting to mechanical means to maintain a pressure level above ambient, whilst building in added protection for the vulnerable eyes and oronasal cavities.

Accordingly, the present invention provides for a respirator comprising at least one integral eyepiece, at least one inlet valve to admit inhaled air and at least one outlet valve to control the egress of exhaled air, characterised in that the respirator further comprises a plurality of inner masks enclosed within an outer mask to form a mask cavity between the inner masks and outer mask when worn, at least one inner mask being an oronasal mask, and at least one other inner mask being an ocular mask, and wherein at least some of the exhaled air is directed into the mask cavity so as to achieve a super-ambient pressure in the mask cavity.

The advantage of this configuration is that by employing a close fitting inner oronasal mask the drop in pressure due to inhalation will be localised in this mask, and any other masks linked to it by ducting, and therefore, there will be no pressure drop in the mask cavity. Also the use of inner masks for the eyes and oronasal areas provides the wearer with two layers of protection from contamination.

By ensuring that some proportion of the exhaled air is directed into the mask cavity, the pressure in that part can be maintained above ambient. The oronasal mask could conveniently be provided with a valve to allow some or all of the exhaled air to be directed into the mask cavity at each exhalation.

The operation of the respirator can be usefully facilitated by employing a main outlet duct or passage from the oronasal area to duct some of the exhaled air away from the mask, conveniently with a non-return valve, and a secondary valve in the oronasal mask to vent some air into the mask cavity.

Advantageously, the main air outlet can be directed into a chamber of the mask to form a further seal, or vented to outside the mask as required.

The secondary valve might conveniently be on a weak spring, or any other suitable return mechanism, that opens and closes at a slight, predetermined over pressure in the oronasal mask. This has the advantage that during the exhale cycle the valve can be made to open and close within the timeframe of the egress of the exhaled air, so that the valve releases any pressure in the oronasal mask into the mask cavity, and closes readily, keeping the mask cavity at above ambient pressure throughout the breathing cycle, even when the pressure in the oronasal mask drops below ambient.

The eyepiece may be held in a single ocular mask, or may be in the form of goggles, and may be linked to the oronasal mask. In such a case, there may be a non return valve or similar mechanism between the oronasal mask and the ocular mask, so that exhaled air is not directed back over the mask's eyepiece.

These inner masks would advantageously be made close fitting and may be equipped with seals to ensure that they are substantially air tight, providing a second level of protection for the more vulnerable areas of the face, and further ensuring that during inhalation, pressure drops are contained within the internal masks.

In order to prevent misting, inhaled air can be drawn into the mask and passed via ducts, over the eyepiece of the ocular mask before being directed towards the oronasal region. By ensuring that the inhaled air is ducted through an ocular mask, rather than simply being guided across the eyepiece, more of the air flow can be employed for demisting. Additionally, the use of a non-return valve between the ocular mask and the oronasal mask, reduces the possibility of wet exhaled air mixing with this airflow to fog the mask.

Furthermore, in other masks in which the air is used to clear the eyepiece, the eyes are open to the outer region of the mask, so that should there be a breach of containment, the eyes could be attacked by chemicals. In this new configuration, the air is ducted to the oronasal area, via the ocular mask or masks from outside. There is no mixing of inhaled air and air from the mask cavity, so even if the mask cavity is breached, the eyes are protected and the mask maintains an eyepiece clearing function.

The eyepiece of the ocular mask may be entirely separate from the outer mask, there being an eyepiece in each, or the eyepiece of the ocular mask could form a single eyepiece, the outer mask being formed around this part of the mask, so that there is a common eyepiece between the inner and outer masks.

The external mask of the respirator might be a flexible hood, conveniently made of a resilient material such as rubber. Around the periphery of the external mask there would advantageously be provided a seal between the mask and the head.

The mask cavity would be formed between this seal and the seal around the oronasal and ocular masks, to create a volume capable of being kept at super ambient pressure during use.

An embodiment of the invention will now be described by way of example only with reference to the accompanying drawing, wherein FIG. 1 is a front vertical section, of the respirator.

With reference to FIG. 1, a respirator 1 comprises two separate inner masks 2, 3 within the body of the respirator 1 so as to form a mask cavity 4 inside the outer mask. Both the ocular mask 2 and the oronasal mask 3 have seals 5,6 respectively to ensure a close, substantially airtight fit with the wearer. Inhaled air is drawn via ducts 8, 9 from the outside 7, and over the eyepiece of the ocular mask 2, before being drawn into the oronasal mask 3. Exhaled air is exhaled via a valve 10 to the outside 7. The eyepiece of the ocular mask forms the eyepiece of the respirator, the outer mask being sealed around the periphery of the ocular mask.

The inlet duct 9 to the oronasal mask is supplied with a non return valve 11 and a secondary valve 12, which is sprung so that it opens after the main valve 10 opens, and closes before the main valve closes. i.e. it operates within the time frame of the exhalation part of the breathing cycle. This secondary valve 12 allows exhaled air to be vented into the mask cavity 4 of the outer mask. The use of such a release valve that opens easily at a slight excess pressure allows the wearer to exhale freely into the cavity, but prevents a decrease in pressure in the mask cavity on inhalation. The outer mask forms a seal 13 with the wearer's head, ensuring that the pressure inside the mask remains super-ambient.

The invention claimed is:

1. A respirator comprising at least one inlet valve to admit inhaled air and at least one first outlet valve to control the egress of exhaled air, the respirator further comprising a plurality of inner masks enclosed within an outer mask to form a mask cavity between the inner masks and outer mask when worn, at least one inner mask being an oronasal mask, and at least one other inner mask being an ocular mask, wherein the oronasel mask is in fluid communication with the first outlet valve and a second outlet valve, the first outlet valve adapted to direct at least some of the exhaled air outside the respirator and the second outlet valve adapted to direct at least some of the exhaled air into the mask cavity so as to achieve a super-ambient pressure in the mask cavity.

2. A respirator as claimed in claim 1, wherein the inner masks are connected to the ambient atmosphere by ducts.

3. A respirator as claimed in claim 2 wherein the masks are linked so as to form an inhalation air path from ambient via the ocular mask or masks to the oronasal area.

4. A respirator as claimed in claim 3 in which the air path between the oronasal and ocular masks is provided with a non-return valve.

5. A respirator as claimed in any of the preceding claims in which the outer mask of the respirator, and the inner ocular mask or masks share a common eyepiece.

6. A respirator as claimed in claim 1, further comprising an eyepiece in the ocular mask or masks that is distinct from an eyepiece in the outer mask of the respirator.

7. A respirator as claimed in claim 1, wherein the first outlet valve is adapted to allow exhaled air to pass during the whole of the exhalation part of the breathing cycle, and the second outlet valve is capable of venting exhaled air into the mask cavity, opening and closing within the timeframe of the exhalation part of the breathing cycle.

* * * * *